United States Patent [19]

Latham et al.

[11] 4,289,096

[45] Sep. 15, 1981

[54] ACCOUSTIC NOISE SUPPRESSION APPARATUS NOISE SUPPRESSION MEANS

[75] Inventors: David D. Latham; Cyril W. Von Fumetti; Wayne R. Miller, all of Dubuque, Iowa

[73] Assignee: Deere & Company, Moline, Ill.

[21] Appl. No.: 54,282

[22] Filed: Jul. 2, 1979

[51] Int. Cl.[3] ..... F02B 77/00

[52] U.S. Cl. ..... 123/198 E; 180/54 A; 181/225

[58] Field of Search ..... 180/54 A, 68 R, 68 P; 181/225, 203, 204; 123/41.7, 198 E, 195 C

[56] References Cited

U.S. PATENT DOCUMENTS

| | | | |
|---|---|---|---|
| 3,530,840 | 9/1970 | Freyn | 123/195 C |
| 3,856,100 | 12/1974 | Manning | 180/54 A |
| 3,857,453 | 12/1974 | Buttke | 180/54 A |
| 3,866,580 | 2/1975 | Whitehurst | 180/54 A |
| 3,951,114 | 4/1976 | Fachbach | 123/198 E |
| 4,071,009 | 1/1978 | Kraina | 123/198 E |
| 4,121,683 | 10/1978 | Kohriyama | 180/68 R |
| 4,122,908 | 10/1978 | Miers | 180/68 P |
| 4,141,334 | 2/1979 | Hatz | 123/198 E |

*Primary Examiner*—Ronald B. Cox

[57] ABSTRACT

The accoustic noise suppression apparatus is mounted opposite a radiator which is in fluid communication with a liquid cooled internal combustion engine having fan generated air flow through the radiator to encounter the noise suppression apparatus. The noise suppression apparatus is tri-sectional, each section including accoustic energy absorbing material. The noise suppression apparatus alter the flow path of the fan driven air flow, exhausting the air to the surrounding environment while decreasing the amount of accoustic noise received by the surrounding environment.

9 Claims, 3 Drawing Figures

ACCOUSTIC NOISE SUPPRESSION APPARATUS NOISE SUPPRESSION MEANS

BACKGROUND OF THE INVENTION

This invention relates to accoustic noise suppression apparatus and, more specifically, to accoustic noise suppression apparatus used in conjunction with a partially encased liquid-cooled power unit having a radiator type heat exchanger.

A considerable percentage of the accoustic noise generated during the operation of a power unit such as a liquid-cooled internal combustion engine is generated by the fan typically employed to drive air through a radiator for engine cooling. With present day concerns for the lowering of noise levels attendant the operation of any type of machinery as transmitted to the surrounding environment, there has been increased focus on minimizing the noise generated by fans utilized in the cooling system of power units. In many cases, fan designs have been made more efficient so as to either minimize the size of the fan required to produce a given air flow or minimize its operating speed, thereby decreasing the amount of noise generated by reason of the resulting ability to utilize smaller or slower fans. In taking such an approach a point is reached whereat only marginal improvements can be obtained since as long as a fan is required, there will be noise attendant to its operation.

To further reduce the level of noise transmitted to the surrounding environment, power units have been partially encased having openings sufficient to allow proper air flow for cooling purposes. Attempts to additionally reduce the level of noise transmitted to the environment where the power unit is partially encased have centered around the deployment of accoustic energy-absorbing material arranged in baffle type apparatus mount in front of and generally perpendicular to the existing air flow path (U.S. Pat. Nos. 3,857,453, 4,071,009, 4,122,908 and 4,121,683). However such attempts have not always been proven successful.

The present invention achieves substantial reduction of the noise associated with a power unit transmitted to the surrounding environment.

SUMMARY OF THE INVENTION

An accoustic noise suppression apparatus for mounting opposite a radiator which is in fluid communication with a liquid cooled internal combustion engine having fan generated air flow through the radiator and encountering the noise suppression apparatus. The noise suppression apparatus is tri-sectional, each section including accoustic energy absorbing material. Each section of the noise suppression apparatus alter the flow path of a related portion of the fan generated air, exhausting the air to the surrounding environment. Additionally each section receives accoustic noise, allowing the accoustic noise to encounter the accoustic energy abosrbing material, thereby decreasing the accoustic noise level transmitted to surrounding environment.

It is an object of this invention to provide increased suppression of the accoustic noise levels associated with the operation of an internal combustion liquid cooled engine with minimum effect on the cooling characteristic on the engine.

DESCRIPTION OF THE PREFERRED EMBODIMENT

Figure 1:
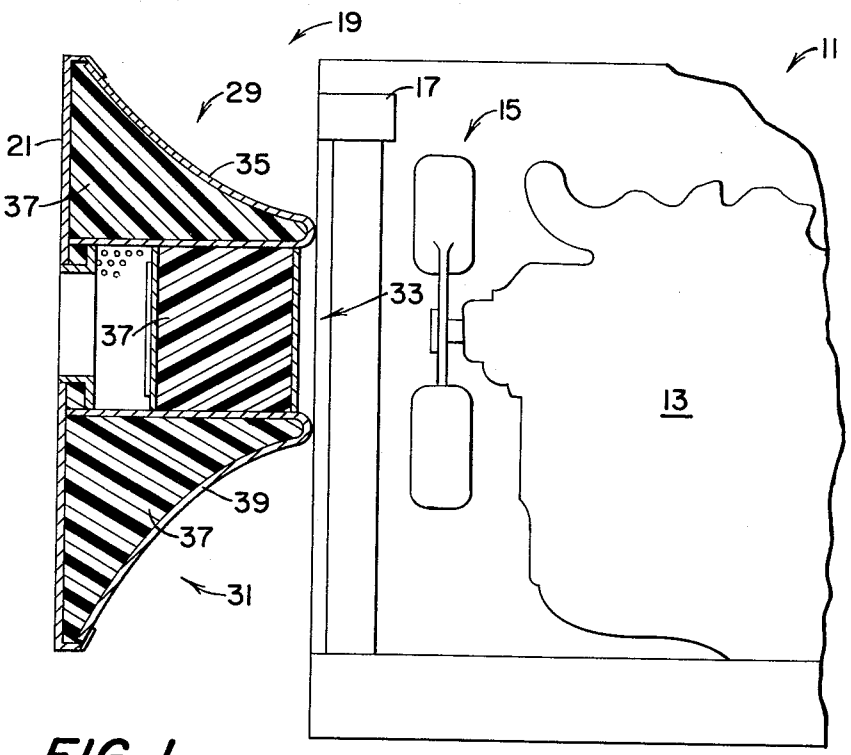
FIG. 1 is sectioned, side elevational view of an accoustic noise suppression apparatus positioned cooperative with a liquid-cooled power unit and contained radiator.

Referring to FIG. 1, a partial encasement, generally indicated as 11, contains a liquid-cooled internal combustion engine 13 having an associated fan 15 which when rotated by the engine 13 drives air through a radiator 17. The fan driven air flow then encounters the accoustic noise suppression apparatus, generally indicated as 19, which is fixably mounted to encasement 11 by any conventional means opposite the radiator 17.

Figure 2:
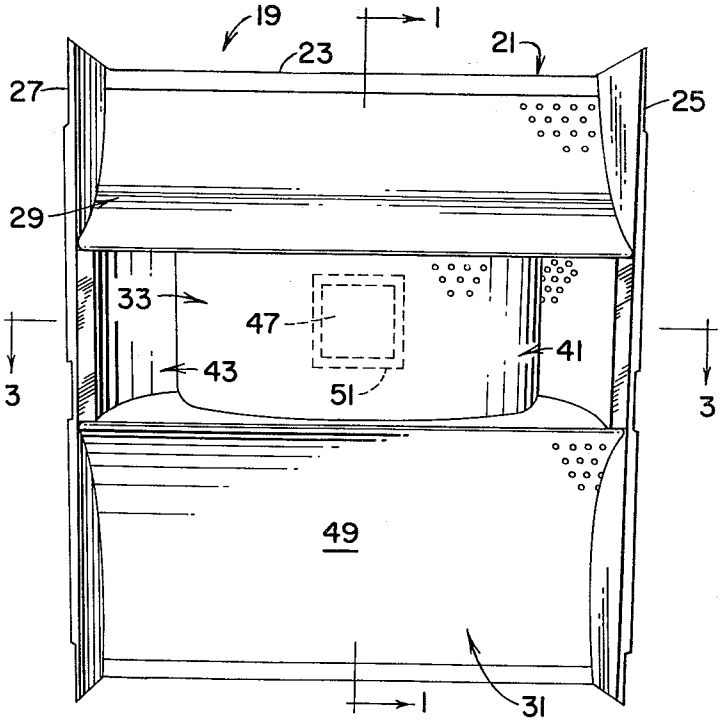
FIG. 2 is an elevational view of the noise suppression means.
Figure 3:
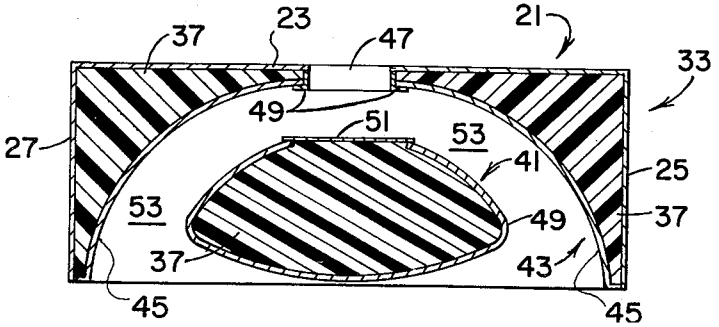
FIG. 3 is a top sectional view of the noise suppression means taken along lines 3—3.

Referring to FIGS. 2 and 3, the accoustic noise suppression apparatus 19 includes a housing 21 comprised of three generally rectangular panels 23, 25, and 27 fixably mounted to each other by any conventional means such that panel 23 forms a back panel, and panels 25 and 27 form opposing side panels. The noise suppression apparatus 19 further includes three contained sections, generally indicated as 29, 31 and 33.

Referring to FIGS. 1 and 2, the first section 29 of the accoustic noise suppression apparatus 19 is comprised of a first screen 35 having one lengthwise edge fixably mounted by any conventional means generally along and colinear with the vertical leading edge of the panel 23, wherefrom the screen 35 assumes a vertically downward sloped outwardly projecting contour i.e., away from panel 23 toward radiator 17, whereafter, screen 35 experiences a change in contour to assume a generally horizontal inwardly projecting contour, i.e., towards panel 23, contacting panel 23 in a generally perpendicular manner. The space enclosed by screen 35 and a portion of panels 23, 25, and 27 is filled with an accoustic energy-absorbing material 37, i.e., fiberglas or polyurethane.

Section 31 is comprised of second screen 39 having one lengthwise edge fixably mounted by any conventional means generally along and colinear with the vertically downward leading edge of panel 23, wherefrom screen 39 assumes a vertically upward sloped outwardly projecting contour, i.e. away from panel 23 toward radiator 17, whereafter, screen 39 experiences a change in contour to assume a generally horizontal contour inwardly projecting contour, i.e., towards panel 23, contacting panel 23 in a generally perpendicular manner. The area enclosed by the screen 39 and a portion of panels 23, 25, and 27 is filled with accoustic energy-absorbing material 37.

Collectively referring to FIGS. 1, 2, and 3, it is observed that section 33 is comprised of two subsections 41 and 43. Subsection 43 is formed by taking a third screen 45 and arching screen 45 between panels 25 and 27 fixably mounting the respective edges thereto by any conventional means, the third screen 45 being arched towards panel 23. A portion of screen 45 is removed and aligned to a hole 47 in panel 23. A mounting member 49 is fixably mounted by any conventional means to panel 23 and the screen 45 around the periphery of hole 47. Accoustic energy-absorbing material 37 is placed in the area enclosed by third screen 45 and portions of panels 23, 25, and 27.

Subsection 41 has a generally ovular shape cross-sectional contour, fixably mounted by any conventional means between the horizontally projecting portions of screen 35 and 39 of sections 29, and 31, respectively, in front of subsection 43. Subsection 41 is comprised of an outer surface formed from a fourth screen 49 partially encasing additional accoustic energy-absorbing material 37. A generally rectangular member or panel 51 is fixably mounted to the ends of the screen 49 opposite to opening 47 to further encase the accoustic energy-absorbing material. The cooperative positioning of the subsection 41 and 43 in conjunction with the horizontally projecting portions of sections 29 and 31 forms a duct or channel 53 (refer to FIG. 3). The air flow traveling in channel 53 is permitted to escape to the environment through opening 47.

The accoustic noise apparatus 19 receives the fan generated air flow and redirects the air flow as defined by either sections 29, 31, or 33. Section 29 receives a portion of the air flow and gradually directs the air flow to assume a generally vertically upward path exhausting the air to the environments. Section 33 receives a portion of the air and conducts the air through the channel 53 exhausting the air through the opening 47 to the environment. Section 31 receives the remaining air flow and redirects the air flow to assume a generally vertically downward path exhausting the air to the environment. Noise generated by fan 15 or other power unit 13 related sources is permitted to encounter the accoustic energy-absorbing material 37, through the screen 35, 39, 45 and 49, whereupon the noise level is substantially reduced due to the properties of the accoustic energy-absorbing material 37. Accoustic noise reflected by panel 23, 25, 27 and 51 will further encounter the accoustic energy absorbing material 37, to further reduce the noise level i.e., reducing the decibel level of the noise transmitted to the environment.

I claim:

1. An accoustic noise suppression apparatus for suppressing accoustic noise associated with the operation of a partially encased liquid-cooled internal combustion engine having a radiator in fluid communication with said engine, a fan to generate air flow through said radiator and encasement opening opposite said radiator, comprising:

(a) a housing fixably mounted to said encasement opposite said radiator and generally perpendicular to said air flow through said radiator and encasement opening, said housing having a back panel and opposing side panels;

(b) accoustic energy absorption material;

(c) first means for receiving a portion of said air flow and accoustic noise passing through said radiator and encasement opening, said first means to alter a portion of said air flow path to exhaust said air flow in a generally vertical direction to the environment and allowing a portion of said accoustic noise to encounter a portion of said accoustic energy absorption material, said first means securely mounted in said housing; and (d) second means for receiving another portion of said air flow and accoustic noise passing through said radiator altering said air flow path by channeling said air flow to exhaust said air flow through an opening in said back panel of said housing to the environment and allowing said accoustic noise to encounter a portion of said accoustic energy absorption material, said second means being securely mounted in said housing.

2. An accoustic noise suppression apparatus as claimed in claim 1, further comprising a third means for receiving a portion of said air flow and accoustic noise passing through said radiator and encasement opening, said third means to alter said flow path to exhaust said air flow in a generally vertical direction opposite to said exhaust direction of said first means to the environment, and allowing a portion of said accoustic noise to encounter a portion of said accoustic energy absorbing material, said third means being securely mounted in said housing.

3. An accoustic noise suppression apparatus as claimed in claim 2, wherein said third means is comprised of a first screen fixably mounted generally completely along the vertically downward lead edge of said back panel of said housing wherefrom said panel assumes a generally sloped outwardly projecting vertically upward contour between said opposing side panels of said housing whereafter said first screen assumes a generally horizontal contour to contact said back panel of said housing, said first screen in cooperation with said side and back panels of said housing to enclose a portion of said accousting energy-absorbing material.

4. An accoustic noise suppression apparatus as claimed in claim 1, wherein said first means is comprised of a second screen fixably mounted generally completely along the vertically upward leading edge of said back panel of said housing wherefrom said panel assumes a generally sloped outwardly projecting vertically downward contour between said opposing side panels of said housing, whereafter said second screen assumes a generally horizontal contour to contact said second screen panel of said housing, said second screen in cooperation with said side and back panels of said housing to enclose a portion of said accoustic energy-absorbing material.

5. An accoustic noise suppression apparatus as claimed in claim 1, wherein said second means is comprised of a third screen securely mounted beneath said first means in said housing, said first screen having a generally oval contour and mounted in said housing such that said third screen is generally perpendicular to said received air flow between said opposing side panels of said housing, said third screen enclosing a portion of said accoustic energy-absorbing material.

6. An accoustic noise suppression apparatus as claimed in claim 5, wherein said second means further comprises a fourth screen having a generally U-shaped contour being fixably mounted in said housing beneath said first and third means, and between said back panel and opposing side panel of said housing behind said third screen, said fourth screen being generally perpendicular to said air flow and having a hole position parallel and perpendicular to said hole of said back panel, a portion of said accoustic energy-absorbing material be placed between said back and side panels, and said fourth screen.

7. An accoustic noise suppression apparatus for suppressing accoustic noise associated with the operation of a partially encased liquid-cooled internal combustion engine having a radiator in fluid communication with said engine, and a fan to generate air flow through said radiator and an encasement opening opposite said radiator to the environment, comprising:

(a) a housing fixably mounted to said encasement opposite said radiator and generally perpendicular to said air flow through said radiator and encasement opening, said housing having a back panel and opposing side panels;

(b) accoustic energy absorbing material;

(c) a first screen fixably mounted generally completely along the vertically upward leading edge of said back panel of said housing wherefrom said panel assumes a generally sloped outwardly projecting vertically downward contour between said opposing side panels of said housing whereafter said first screen assumes a generally horizontal contour to contact said back panel of said housing, said first screen in cooperation with said back and said panels to contain a portion of said accoustic energy-absorbing material;

(d) a second screen having a generally U-shaped contour being securely mounted in said housing beneath said first screen, and between said back panel and opposing side panels of said housing, said second screen having a hole positioned to be in front of a hole in said back panel, said second screen and said back and side panels to contain a portion of said accousting energy-absorbing material such that said hole in said back panel and second screen are not obstructed;

(e) a third screen fixably mounted generally completely along the vertically downward leading edge of said back panel of said housing wherefrom said panel assumes a generally sloped outwardly projecting vertically upward contour between said opposing side panels of said housing whereafter said third panel assumes a generally horizontal contour to contact said back panel of said housing beneath said second panel, said screen and said back and side panels to contain a portion of said accousting energy-absorbing material.

8. An accoustic noise suppression apparatus as claimed in claim 7, further comprising a fourth screen fixably mounted between said first and third screens and in front of said fourth screen in said housing, said fourth panel having a generally oval shaped contour containing a portion of said accoustic energy-absorbing material mounted in said housing such that said air flow encounters said fourth panel in a generally perpendicular manner.

9. An accoustic noise suppression apparatus as claimed in claim 8, further comprising a generally rectangular member fixably mounted to said fourth screen opposite said hole in said back panel.

* * * * *